United States Patent [19]

Leanna et al.

[11] Patent Number: 4,704,296

[45] Date of Patent: Nov. 3, 1987

[54] WEB COATING METHOD AND APPARATUS

[75] Inventors: Dale D. Leanna, Lt. Suamico; Eugene R. Wittkopf, Suamico; Allen R. Jorgensen, Abrams, all of Wis.

[73] Assignee: Magna-Graphics Corporation, Oconto Falls, Wis.

[21] Appl. No.: 655,901

[22] Filed: Sep. 28, 1984

[51] Int. Cl.[4] ..... B05D 1/28; B05C 1/12; B05C 11/00

[52] U.S. Cl. ..... 427/9; 118/249; 118/261; 118/262; 118/665; 118/697; 427/10; 427/428

[58] Field of Search ..... 427/9, 10, 428; 118/665, 46, 261, 249, 262, 697

[56] References Cited

U.S. PATENT DOCUMENTS 2,406,056 8/1946 Barrett ..... 118/249

FOREIGN PATENT DOCUMENTS 1177311 1/1970 United Kingdom ..... 427/428

*Primary Examiner*—Evan K. Lawrence

*Attorney, Agent, or Firm*—Andrus, Sceales, Starke & Sawall

[57] ABSTRACT

A coater includes an impression cylinder and a gravure cylinder rotatably mounted. A first pivot arm unit is pivoted on the impression cylinder shaft and supports a pivot shaft. Depending pivot arms on the shaft support an offset cylinder to one side of the impression cylinder and above the gravure cylinder. Nip adjustment units for the pivot arm unit and the depending pivot arms each include a pre-loaded ball bearing lead screw coupled to a slide housing and a separate power cylinder connected to the pivot unit and pivot arms respectively. The power cylinder unit forces the pivot structure into engagement with the lead screw follower which acts as a stop. A stepping motor rotates the lead screw and accurately positions the stop and thereby the pivot structure as a result of the power cylinder units. The lead screws separately control the nip setting of the off-set cylinder relative to the impression cylinder and the gravure cylinders. The stepping motors may be separately actuated to establish precise parallelism of the cylinders and simultaneously actuated to set the nip position. A coating thickness sensor coupled to the coated web is connected to a programmable controller having an output connected to operate the stepping motors to maintain a selected coating. In the method of operating the apparatus, a direct mode is used to apply coating to a web passing between the gravure and offset cylinders, or an indirect mode is used to apply coating to a web passing between the offset and impression cylinders.

15 Claims, 10 Drawing Figures

PROGRAMMABLE CONTROLLER 24

4
23
60
51
5
5
54
20
27
47
45
19
21
25
43
46
35
13
12
14
40
41
39
18
4
28
10
9
15
7
10
61
62
8
61a
6
22
17
16
7
70
6
7a
26
6
7
27
11

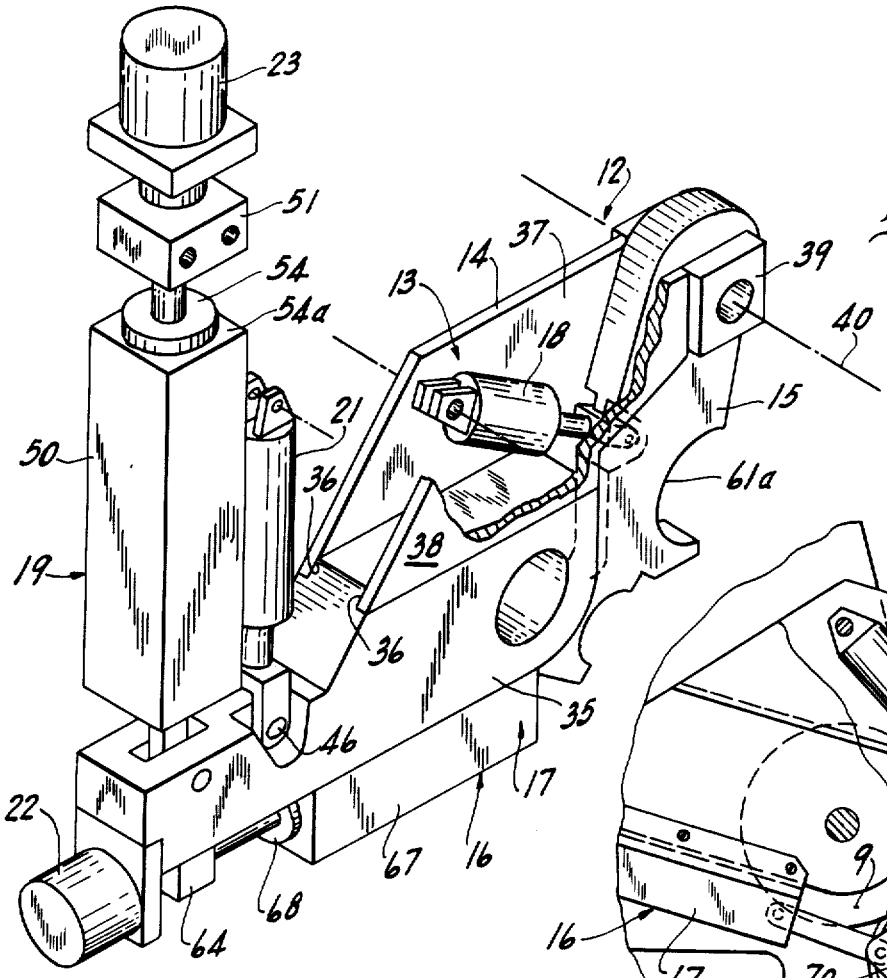
Fig. 3
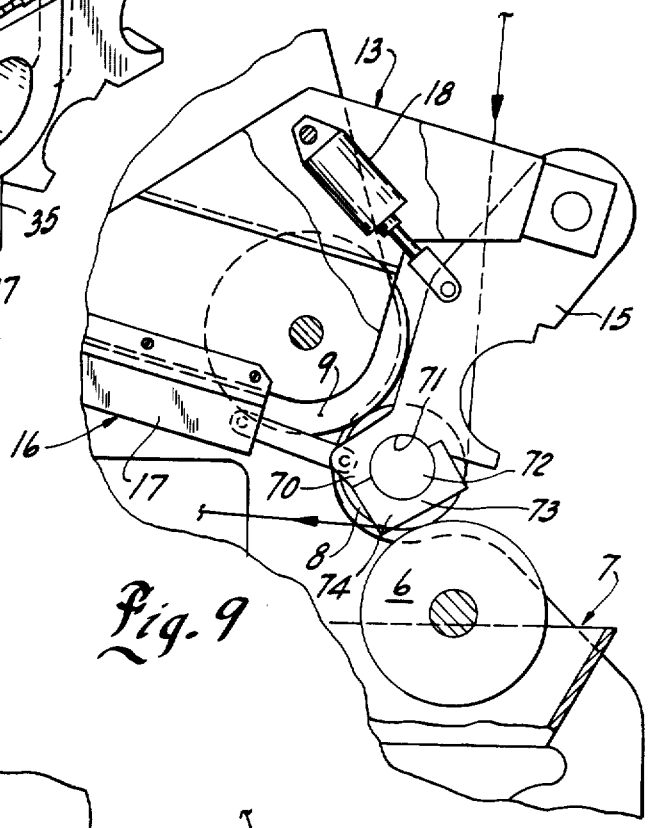
Fig. 9
Fig. 10
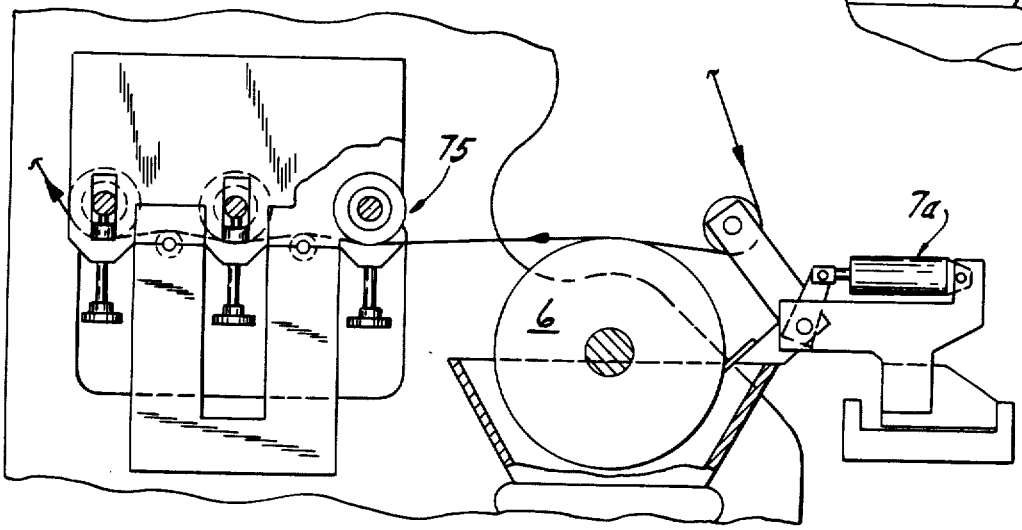

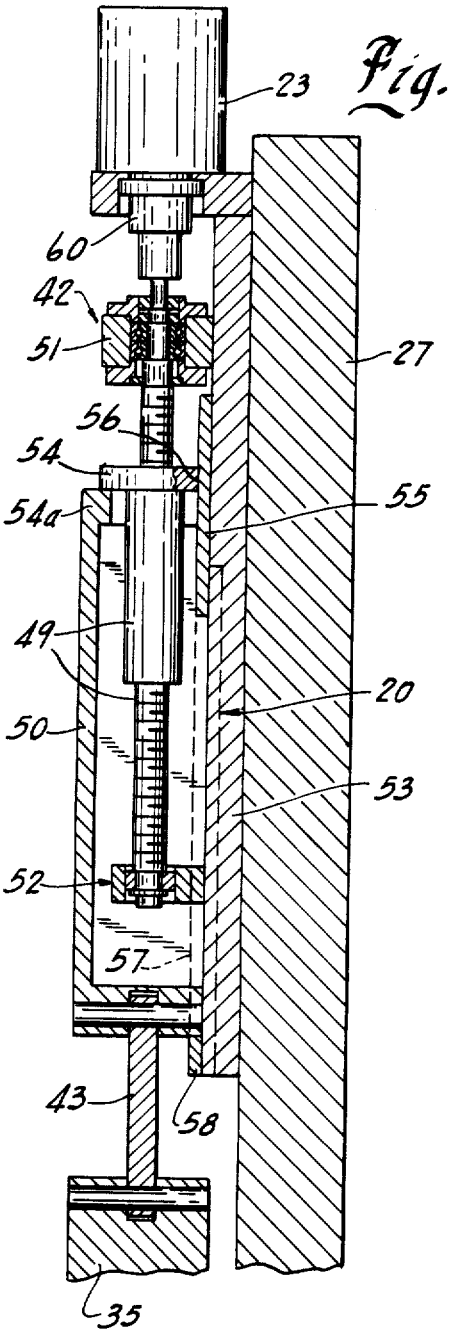
Fig. 4
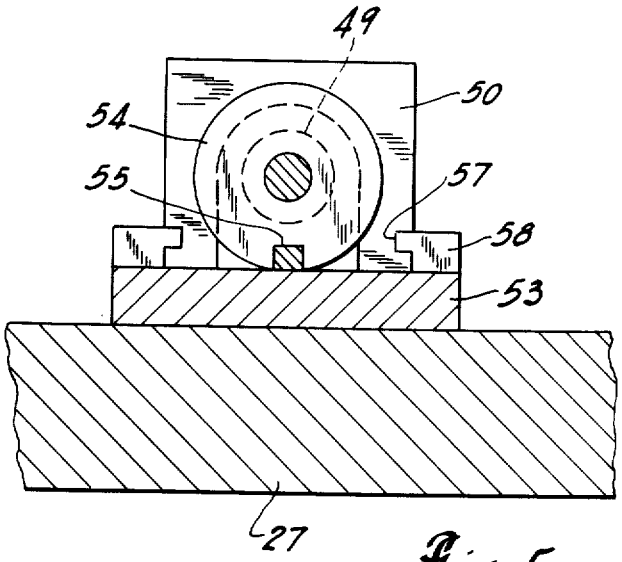
Fig. 5
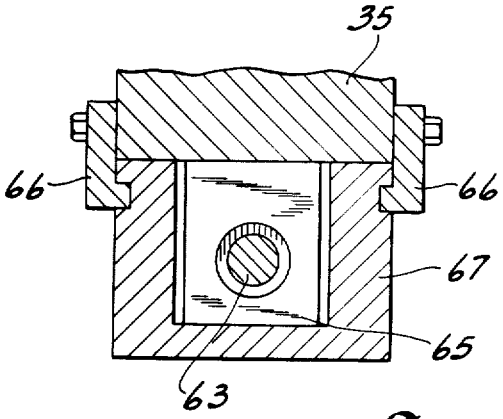
Fig. 7
Fig. 6
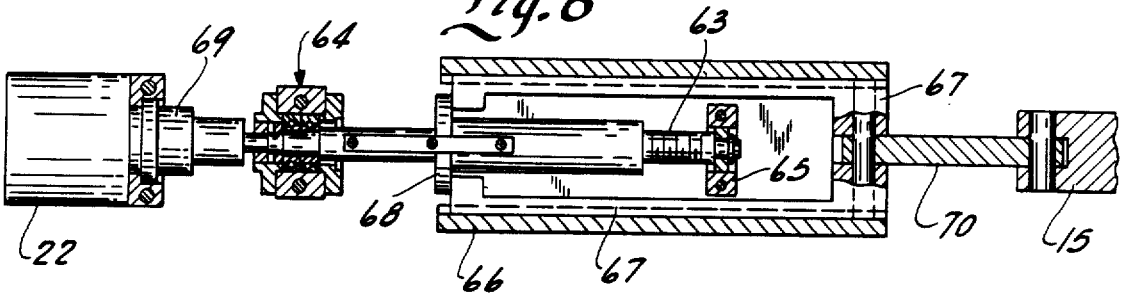

WEB COATING METHOD AND APPARATUS

BACKGROUND OF THE PRESENT INVENTION

This invention relates to a web coating or printing apparatus and particularly to a web coater for applying a thin film of material onto an elongated web. The invention is also directed to a method of applying a coating based on such apparatus.

Many applications require a web member having a coating applied to one face. The recording and copying fields often use a web or tape like member having a coating on the face thereof. In the manufacture of the coated web, a large roll of the web material is formed for subsequent application of the coating. The web is fed from the roll through a coating apparatus which is specially constructed to deposit a thin film of the coating onto the web, with the coated web subsequently processed such as rewound for subsequent processing into retail sized tapes or other suitable products. The specification for certain products require a uniform coating of constant thickness which in turn requires highly accurate monitoring of the coating process. This is particularly true in those applications where the coating material is a relatively expensive material. For example, a silconecoated web is a typical example where the cost of the silcone coating material is a signficant part of the final product cost. As a result, silicone coating is applied to the web using highly precision formed apparatus such as a gravure coating apparatus. The gravure applicator may use an offset construction or alternatively a direct imprinting construction. The particular method will of course be dictated by the specifications in accordance with well-known procedures. Generally in such applications, the apparatus is set up by the operator to apply a coating of a certain thickness. A piece of the coated web is withdrawn, the coating removed and weighed to determine the accuracy of the application. This provides a reasonably quick determination of the quantity of material being deposited. The thickness of the coating may of course vary substantially from one specification to the next, depending upon the application, the materials of the web and coating and other factors known to those in the art. The apparatus should therefore provide for convenient adjustment of the thickness, preferably with the machine in operation. Finally, with the alternate method of application, a single machine which can be readily converted between an offset construction and a direct gravure construction would be highly desirable for purposes of minimizing the fixed machine cost to the coater company. In both instances of course, the necessary precision construction as well as adjustable features should be maintained in order to provide satisfactory low cost coating of the web.

SUMMARY OF THE INVENTION

The present invention is particularly directed to a coating method and coating apparatus specially constructed to apply a closely regulated and uniform film or layer of material to a web, and particularly such a machine having means for accurate adjustment of the coating. In accordance with the further aspect of the invention, the machine is preferably constructed to permit conversion of the machine for offset and direct gravure coating of the web. Generally in accordance with the teaching of the present invention, the apparatus is constructed with a rigid frame within which an impression cylinder is mounted in combination with a pivotally mounted offset cylinder and a gravure cylinder. The offset cylinder is mounted in a special dual pivot support assembly for pivotal movement with respect to the impression cylinder and the gravure cylinder. In construction, the offset cylinder is mounted by a pendant pivot means to a pivot support unit or assembly which in turn is pivotally mounted on the axis of the impression cylinder. Similar high pressure adjustment means are separately secured to adjust the pivot support assembly and to the pendant pivot means for adjusting the nip between the offset cylinder and the gravure cylinder and between the impression cylinder and the offset cylinder. Each adjustment means is preferably similarly constructed and includes a high force motive positioning means such as a hydraulic piston/cylinders unit and an adjustable stop which in the optinium construction is a preloaded rotary bearing lead screw positioning mechanism. A stepping motor and harmonic motion reducer are coupled to the lead screw for positioning a stop, which moves the offset cylinder in steps of 5 millionths of an inch. The hydraulic cylinder unit is also secured to the pivot means and to the pivot support unit and provides a continuous force acting against which the lead screw mechanism which operates such that the rotation of the lead screws accurately positions the associated cylinder. The preloaded bearing construction removes all backlash and tolerance movement within the lead screw adjustment and the stepping motor drive accurately and precisely positions the corresponding offset cylinder.

The inventor has discovered that the dual pivot support of the common offset cylinder in combination with the preloaded lead screw adjustment means provides highly accurate positioning and support for the cylinder whereby a coating of uniform thickness is accurately applied to a web moving between the cylinders and wherein the thickness of the coating can be accurately adjusted by the operator.

The positioning drives for the nip adjustment means in another aspect of the invention includes a programmable controller. Suitable sensors such as reflective infrared units are mounted adjacent to the face of the coated web to continuously monitor any change in the web thickness. The signal is sent to the programmable controller to provide automatic adjustment of the position of the cylinder nip adjustment units and thereby the offset cylinder, such as through appropriate stepped movement of the stepping motors, to maintain the preset coating thickness. The operator need only to ensure that in setting up the machine for the coating run that the coating thickness selected is proper. This of course can be readily determined in accordance with the conventional procedure.

More particularly in a preferred construction of the present invention, a heavy rigid frame structure includes two side frame members. The impression cylinder is rotatably mounted in the frame members by high precision bearings. A pivot arm is rotatably mounted on the shaft of the impression cylinder, one at each end of the cylinder. A preloaded lead screw and a power cylinder unit is mounted for each pivot arm extending generally perpendicular to the axis of the impression pivot member and the offset cylinder. The one end of the unit is fixed to the frame structure and the opposite end is secured to the pivot arm pivoted on the impression cylinder shaft. The pivot arms extend upwardly and outwardly over the impression cylinder. A pivot shaft is rotatably mounted in the pivot arm extended portions. A pair of pendant pivot arms are secured to the pivot shaft and extend downwardly to the offset cylinder. The offset cylinder is rotatably mounted in the lower ends of pivot arms. Preloaded ball bearing lead screw units are coupled one to each of the depending pivot arms and extend substantially perpendicular to the first lead screw unit for positioning the offset cylinder relative to the impression cylinder. The gravure cylinder is mounted in a suitable high precision bearing generally in vertical alignment with the offset cylinder. An appropriate doctor blade unit and the like is secured adjacent the gravure cylinder to apply the coating material to such cylinder for transfer to the web directly, or to the offset cylinder for application to the web as it moves between the offset cylinder and the impression cylinder.

The inventor has discovered that the present invention provides a versatile and highly adaptable dual coating mechanism for coating of web material with a uniform adjustable thickness coating. The present invention is thus particularly adapted to coating of a web with silcone and other highly costly or expensive coating material.

BRIEF DESCRIPTION OF THE DRAWINGS

The drawing furnished herewith illustrates a preferred construction of the present invention in which the above advantages and features are clearly disclosed as well as others which will be readily understood from the following description.

In the drawing,

FIG. 3 is a perspective view of a portion of the apparatus shown in FIGS. 1–2.

FIG. 4. is a sectional view showing a lead screw unit shown in FIGS. 1–3;

FIG. 5. is longitudinal section through a positioning unit shown in FIGS. 1–3;

FIG. 6. is a transverse section of FIG. 5 showing detail of the mounting positioning unit;

FIG. 7. is longitudinal section through another positioning unit similar to FIG. 5;

FIG. 9. is a fragmentary view showing an alternate offset cylinder and gravure cylinder;

FIG. 10. is a view of the apparatus shown in FIG. 1 modified for use as a Mayer roll web processor.

DESCRIPTION OF THE ILLUSTRATED EMBODIMENT

Figure 1:
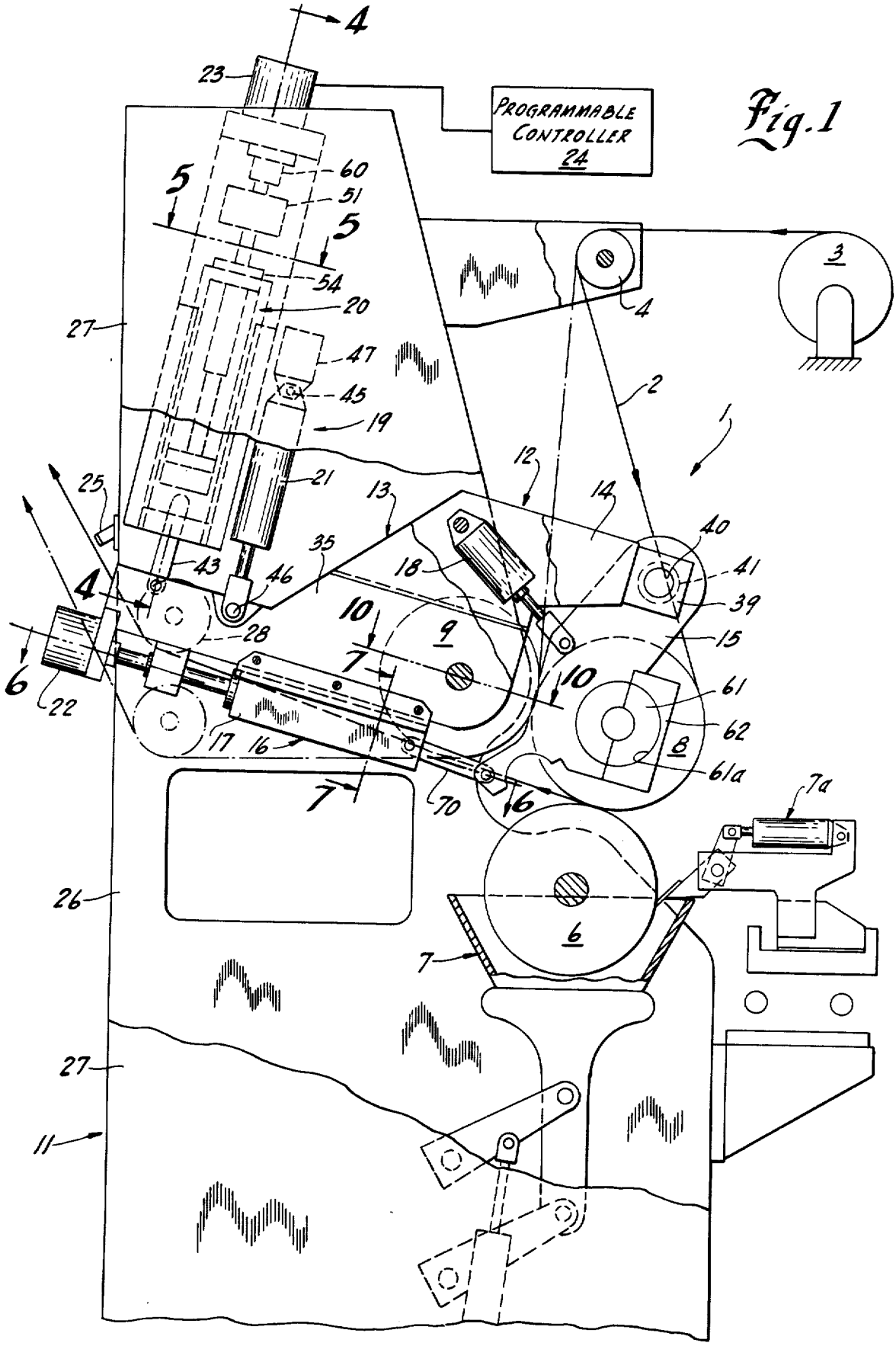
FIG. 1 is a side view of a coating apparatus, with parts broken away and sectioned to show detail of construction.
Figure 2:
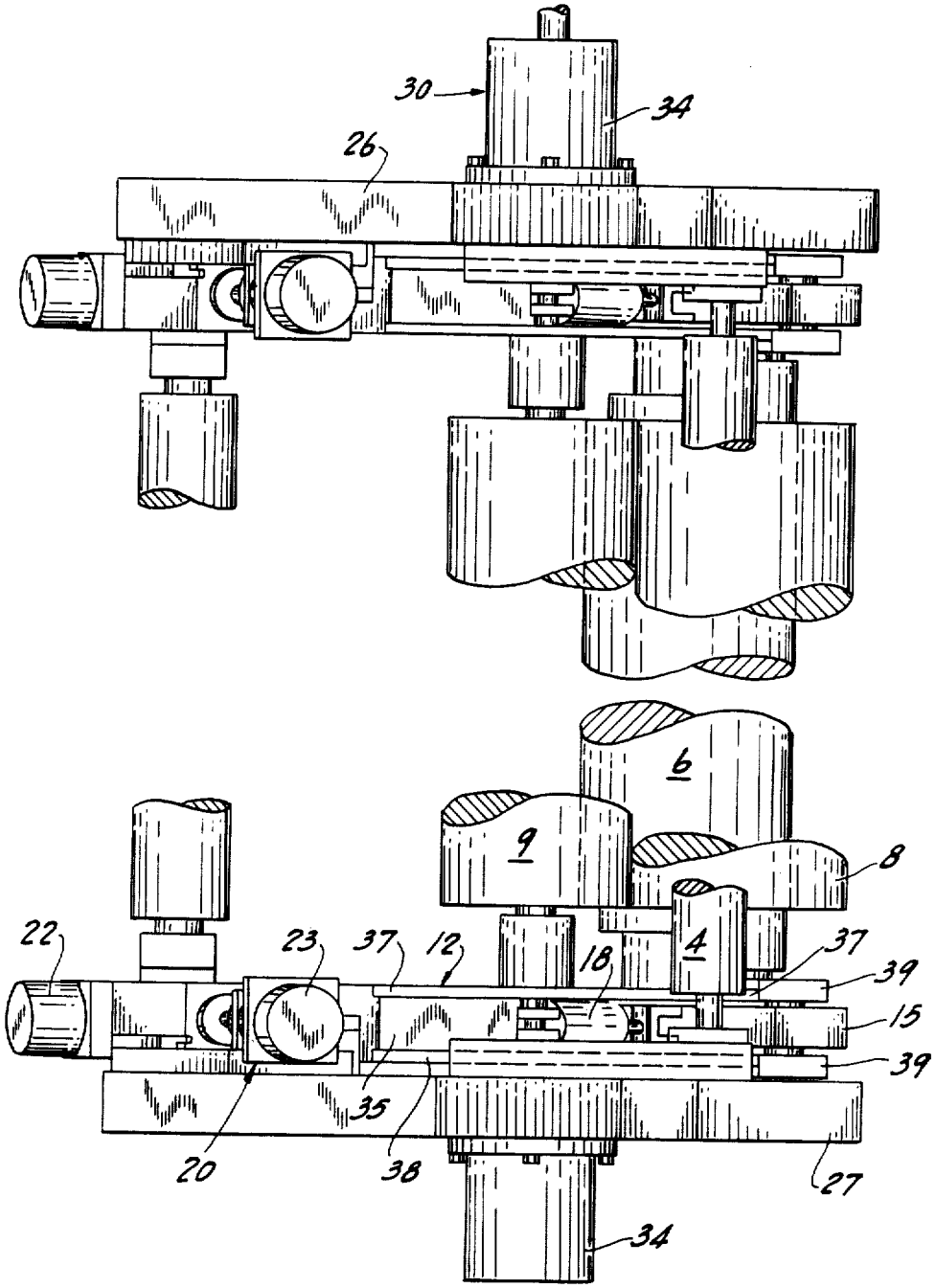
FIG. 2 is a top view of the apparatus shown in FIG. 1.

Referring to the drawings and particularly to FIGS. 1 and 2, a printing or coating apparatus 1 is illustrated for applying a coating to a web 2 and particularly to the one surface of the web 2. The apparatus 1 is a rotary press-type construction and the web 2 is withdrawn from a source such as a large roll 3 of the material rotatably supported in an unwind stand. The web 2 is passed over a spreader roll 4 at the input side of the apparatus 1, passes through the apparatus and is discharged over a guide roll, not shown, to a suitable rewind stand or other processing apparatus, not shown. The illustrated apparatus 1 is a gravure applicator including a gravure cylinder 6 rotatably mounted within the apparatus and relative to a fountain unit 7 containing the coating material to be applied to the web 2. Rotation of the gravure cylinder 6 results in the application of the appropriate coating material to the gravure cylinder 6. A doctor blade assembly **7*a* is associated with the gravure cylinder 6 to remove excess coating material in accordance with conventional practice. The doctor blade assembly 7*a* may be mounted to the opposite side of the gravure cylinder for coating on the opposite side of the web. An offset cylinder 8 is mounted in opposed relation above cylinder 6 and an impression cylinder 9 is mounted to the outfeed side of the apparatus. The impression cylinder, as shown in FIG. 1, is located to the outfeed side of the offset cylinder and the axis of the impression cylinder is above the axis of the offset cylinder 8. The web 2 is adapted to be passed downwardly from the spreader roll 4 between the impression cylinder 9 and the offset cylinder 8 as shown in phantom in FIG. 1, or alternatively directly between the offset cylinder 8 and the gravure cylinder 6 as shown in full line illustration. This will of course be determined by the particular coating specification. The present invention is particularly directed to the mounting and the positioning mechanism establishing the proper nip setting between the impression cylinder 9 and the offset cylinder 8, and also between the offset cylinder 8 and the gravure cylinder 6. In the illustrated embodiment of the invention, the gravure cylinder 6 and the impression cylinder 9 are rotatably mounted in fixed relation in a suitable frame structure 11. The cylinders 6 and 9 are mounted in fixed relation, and are both constructed and mounted as high quality, precision rotary applicating cylinders. Thus, the cylinders have precisely formed surfaces and mounting shafts which where mounted in high precision bearings establish and maintain precise parallelism and true rotating surfaces. The offset cylinder 8 is similarly constructed and is mounted in a special dual pivot assembly 12 for accurate positioning with respect to the gravure cylinder 6 and the impression cylinder 9. The pivot assembly 12 includes identical assemblies at each end of the offset cylinder 8. Each pivot assembly includes a first pivot arm unit 13 which is pivotably mounted about the axis of the impression cylinder 9, and includes an upper portion 14 extending outwardly over the offset cylinder 8. Depending pivot arms 15 are pivoted to unit 13 and particularly within the outer ends of the upper portion 14. The offset cylinder 8 is rotatably mounted in the lower ends of the pivot arms 15. A first nip power adjustment unit 16 is coupled to the pivot arms 15 and to the adjacent portion of the pivot arm unit 13 for adjusting the nip or spacing of the offset cylinder 8 with respect to the impression cylinder 9. The adjustment unit 16 includes a precision lead screw unit 17 secured to the pivot arm unit 13 and having a pivotal coupling to the lowermost ends of the pivot arms 15. The adjustment unit further includes a power cylinder unit 18 coupled between the pivot arm unit 13 and the pivot arms 15 to force the arm unit against the lead screw unit 17 as a stop to load the arm 15 for insuring high precision movement and placement of the pivot arm unit 13 and thereby the offset cylinder 8 relative to the impression cylinder 9**. This provides accurate setting of the nip therebetween.

A second nip power adjustment unit 19 includes a precision lead screw unit 20 and hydraulic power cylinder unit 21 connected between the frame structure 11 and the outer end portion of the first pivot arm unit 13.

The lead screw unit 20 acts as an adjustable stop and positions the offset cylinder 8 with respect to the gravure cylinder 6. Pivoting of the dual pivot assembly 12 about the impression cylinder axis results in a corresponding pivotal movement of the pivot arms 15 for corresponding movement of the offset cylinder.

The lead screw positioning units 17 and 20 may of course be operated in any desired manner. In a particularly practical and unique construction, individual motor units 22–23 are coupled one each to each of the lead screw units 17 and 20. For high precision coatings, motors 22–23 are stepping motors and are referred to for descriptive purposes. The stepping motors 22–23 are constructed and arranged to jointly act with the corresponding lead screw units to establish movements on the order of five millionths of an inch per motor step. The stepping motors in turn may be suitably connected to a programmable controller 24 having suitable manual or automatic input controls for programmed positioning and movement of the offset cylinder 8 with respect to the gravure cylinder 6 and the impression cylinder 9.

The operator thus sets up the coater apparatus 1 for either direct or offset coating. With direct coating the offset cylinder 8 is spaced from the impression cylinder 9 to avoid any interference therebetween, and allow the direct movement and interaction as a result of the movement of the web 2 between the offset cylinder 8 and the gravure cylinder 6. The speed of the gravure cylinder may be operated at match speed and smoothing rolls may be used to smooth out the coatings. The speed of the gravure cylinder may also be operated above match speed to directly smooth out the coatings. In an offset coating mode, the offset cylinder is set to receive the coating from the gravure cylinder and the impression cylnder is set to have the web pass directly between the offset and impression cylinder (as shown in phantom) to transfer the coating to the offset cylinder and then to the web. In either type of coating, the operator will establish the offset of the offset cylinder 8 with respect to the appropriate cylinders to develop and establish a particular coating thickness. The stepping motors 22 and 23 may be separately operated to establish precise parallelism between the cylinder 8 and the cylinders 6 and 9. Then, motors 22 and 23 are operated simutaneously to adjust the nip. An initial trial run is made. Coating material is removed from a known area of the web 3 and weighed to determine the amount of coating being deposited per unit area. The operator can readily determine from this analysis whether or not the apparatus is applying the proper coating thickness. If adjustment is required, the operator merely actuates the programmable controller 24 to appropriately drive the lead screw units 17 and/or 20 for either increasing or decreasing the appropriate nip setting and thereby establish the desired change in thickness. Once the appropriate thickness has been established, the machine operates to continuously deposit the appropriate layer or coating upon the moving web 2.

Suitable thickness sensors 25, such as reflective infrared sensors, may be coupled to the coated web 2 to monitor the thickness of the coating. The sensors 25 are coupled to the controller 24 into a closed loop system for positioning the offset cylinder 8. The sensors 25 determine any variation in the thickness from the preset level and actuate the programmable controller 24 to actuate the proper motor 22–23 and reset the nip to maintain the desired preset thickness. The inventor has found that the dual pivot mounting and support of offset cylinder 8 in combination with the precision positioning units 16 and 19 and the precision quality of the construction and mounting of all cylinders results in a highly accurate and effective means and system for precisely controlling the thickness of the coating with uniform application of the coating. The quality of the products is excellent and relatively inexpensive. The cost factor may be of particular significance where the coating material is a relatively expensive coating material, such as silcone. For example, silcone coatings may require application as low as 0.2 pounds per 3,000 square feet of web.

The coating apparatus may require different basic sizes of a gravure and offset cylinders. The pivot arms 15 may be specially constructed as more fully developed hereinafter to accomodate either of two appropriate sized offset cylinders and related sized gravure cylinders.

Figure 8:
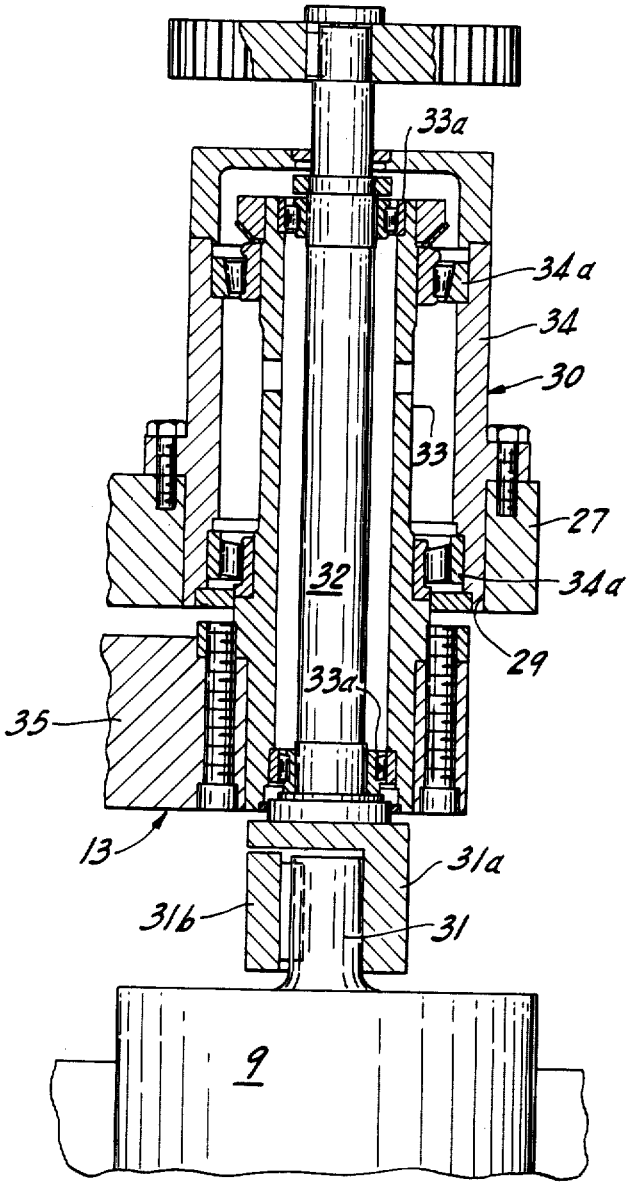
FIG. 8. is a transverse section of FIG. 7 showing detail of the mounting of the positioning unit.

More particularly, in the illustrated embodiment of the invention, the rigid frame structure 11 includes heavy machine side frame plates which produce the necessary support of the cylinders to maintain precise location with respect to each other for the degree of accuracy required. The side frame plates 26 and 27 are identically mirrow images and include a substantially rectangular lower base portion within which the gravure cylinder 6 is supported and a projecting top portion on one side of the base portion within which the offset cylinder 8 and the impression cylinder 9, with the pivot assembly 13 are mounted. The web 2 passes down through the exposed upper portion into the cylinders 6–9 and is discharged from between the opposite end of the side frame plates over a guide roll, not shown. The side plates 26–27 are interconnected by suitable spacers to form a rigid support. Appropriate bearing openings 29 are provided adjacent the connection of the upper and lower portions of the frame for receiving of a high precision bearing structure 30 for the impression cylinder 9, as shown in FIG. 8.

The impression cylinder 9 is a conventional cylinder having end shafts 31 constructed as a high quality precision unit which is mounted to a high precision multiple cone bearing unit by a suitable cupped coupling **31*a* having a removable cap 31*b* to a bearing shaft 32 which is rotatably supported in a bearing housing 33 by high precision rotary bearing 33*a* for firmly rotatably supporting of the impression cylinder. The drive for the impression cylinder 9 projects outwardly to the one side of the side frame 26 for coupling to any suitable conventional drive system, not shown. The axis of the impression cylinder 9 is a fixed reference from which the other cylinders are mounted and moved. The suitable bearing structure as shown in FIG. 8 which includes bearing housing 33 rotatably supporting the impression cylinder. In addition, a pivot bearing housing 34 is similarly mounted on the impression cylinder housing 33 by cone bearing 34*a* and bolted or otherwise affixed to frame 27 the pivot assembly 12 coupled to the housing 33**.

Referring particularly to FIGS. 2 and 3 pivot arm arm unit 13 of assembly 12 includes a first pivot member 35 which has an opening through which housing 33 passes and to which the arm member 35 is bolted or otherwise secured to support the pivot assembly 12 on the axis of the impression cylinder 9. The pivot arm member 35 is a heavy, rigid arm or plate which projects rearwardly through the upper portion of the frame 11 adjacent frame 27, terminating immediately within the frame structure. The nip adjustment unit 19 is secured to and supports the outer end of the pivot member 35 and thereby the pivot arm unit 13 in precise location with respect to the impression cylinder 9. The upper edge of the pivot member 35 includes longitudinal recesses 36 on the opposite sides thereof. First and second pivot plates 37 and 38 are bolted or otherwise rigidly and firmly secured in the arm recesses to form an effective integral upper portion of the pivot arms 14 of the pivot arm unit 13.

Each plate 37–38 has a bottom straight edge mating with a recessed edge of the base pivot member 35. The back edge is inclined upperwardly from the base plate member 35 to a top edge which extends outwardly in the direction over the impression cylinder 9. The front edge of the plate 36 includes a relatively straight vertical portion and an outwardly inclined portion. A pivot shaft bracket 39 is welded to the top outer end of the pivot plates 37–38 for receiving a pivot shaft 40 for the offset cylinder 8.

The two pivot plates 37–38 of the pivot assembly 13 are similarly journaled on the pivot shaft 40 by suitable high precision bearing structures 41. The shaft 40 and pivot plates 37–38 are free to pivot relative to each other.

The positioning unit 19 supports the assembly 13 and particular pivot arm members 14 as follows. The lead screw unit 20 is secured to the adjacent frame member 27 by a mounting bearing unit 42 and depends downwardly therefrom. The lower end is coupled to the pivot arm 35 by a pinned link 43. The hydraulic power cylinder unit 21 is fixed to the frame 27 by a pinned connection 45 and to the arm 35 by a pinned connection 46.

More particularly, the hydraulic power cylinder unit 21 is any suitable high quality device adapted to function as a firm reliable force holding the pivot against the adjustment unit and particularly the lead screw unit 20. As shown in FIG. 3, the piston rod terminates in a clevis which is pinned at 46 to an appropriate plate-like portion of the impression cylinder arm 35. The opposite end of the cylinder 21 has a mounting plate 47 which is bolted or otherwise rigidly affixed to the frame 27 with a spacer or other means disposed between the plate 47 and frame 27 to appropriately locate the pivot arm unit 13 on the offset cylinder pivot shaft 40.

The preloaded ball bearing lead screw unit 20 includes lead screw 49 of any high precision construction. A particularly satisfactory unit is manufactured by Warner Electric Brake and Clutch Company of South Beloit, Ill. particularly model no. RP1004A. The preloaded ball bearing lead screw 49 is rotatably mounted within a housing slide 50. The slide 50 is generally a rectangular elongated housing having the one side open or exposed. The screw 49 is rotatably mounted in a pair of spaced bearing housings 51–52 which are secured to a mounting plate 53. The plate 53 is fixed to the frame 27. A follower 54 is threaded on the screw 49 and located adjacent the exterior of the end wall **54*a* through which the screw 49 extends. A coupling key 55 rides in a slot 56 in to the follower 54. The key 55 in turn is secured to the frame plate 53 to prevent turning of the follower. The opposite sides of the slide adjacent to the open end are provided with slide grooves or tracks 57. A pair of track gibs 58 are rigidly affixed to the support to the opposite sides of the slide and mate with the slide grooves 57 to slideably support the slide in relationship to the follower 54 and the movable pivot arm 35. The pivot link 43 is pivotably affixed or pinned to the end of the slide 50 at one end and to the pivot member 35 at the opposite end. The rotation of the lead screw 49 causes the follower 54 to move and thus adjust the stop position of the stop for the slide 50, which moves with a corresponding linear motion of the pivot member 35, which of course moves with a pivotal motion. The bearing supports and the ball screw construction is such that the precision positoning of the pivotal unit 13 results. A harmonic reducer 60 is secured between the outer driven end of the ball screw and the motor to allow the motor 23 to move against the high forces used in the cylinder positioning and nip forces and thus provide accurate positioning by the lead screw and follower 54. The step motor 23 for the unit is preferably of a type which will produce a motion of five millionths of an inch for each step movement of the motor. This of course permits the extremely accurate positoning of the pivotal member 35 and the interconnected offset cylinder shaft 40 with respect to the other cylinders 6 and 9**. Where such precision is not required other motive means may be used. For example, synchronous motors have been used. Even manually operated hand wheels or the like may be used to make the adjustments if the accuracy requirements permit. The hand wheel would permit individual adjustment, with suitable releasable coupling to five simultaneous movement.

The offset cylinder pivot arms 15 are pivotedly mounted on the pivot shaft 40. Each arm 15 is mounted on the shaft 40 between the corresponding pivot plates 37–38 by suitable high precision bearings 41. Each arm 15 is a heavy metal plate member having an upper end opening in which the support bearing 41 is locked and the arm depends downwardly from the shaft 40.

The outer edge of the arm 15 is provided with a bearing recess or opening **61*a* for receiving the shaft bearing 61 of the offset cylinder 8. In particular, the bearing unit 61 is secured to the offset cylinder shaft and mates with the recess 61*a* in the depending arms. A bearing cap 62 is bolted or otherwise secured to the arm 15** and secures the bearing within the arm.

The offset cylinder is thus supported in the pair of pivot arms 15 mounted to the opposite ends of the offset cylinder 8 and particularly between the pivot plates of the pivot assembly 13.

The offset-to-impression cylinder nip adjustment unit 16 is mounted to the pivot arm 35 as most clearly shown in FIGS. 1 and 6. The lead screw unit 17 of the unit 16 is constructed in the same manner as unit 20. The lead screw 63 is supported in bearing housings 64 and 65 which are bolted to the underside of arm 35 to rigidly support the lead screw mechanism in position. L-shaped gib members 66 are secured to the side of the impression cylinder pivot arm 35 and mate with the slide tracks in the side of the slide 67 to slideably support the slide for the desired movement.

The follower 68 is in the path of the slide 67 and acts as a stop, and the slide is held against the stop and moves in response to energization of the stepping motor 22 and repositioning of the stop. A harmonic reducer 69 establishes similar step movement. A link 70 pivotably connects the end of slide 67 to the lower end of the arm 15. The arm 15 is thereby firmly held by the power cylinder unit 18 which is pivotably connected to the plates 37–38 and to the arm 15.

The lower end of the offset cylinder arm 15 is shown extended laterally and downwardly from the illustrated cylinder bearing as at 71 to from an alternate bearing connection for a range of small offset cylinders, as shown in FIG. 9. The lower end of arm 15 is formed with a bearing recess 72 in which a high precision rotary bearing 73 is clamped by a bolted cap 74. The coater otherwise operates in the same manner as the unit shown in FIG. 1.

The apparatus is also particularly adapted to conversion into a mayer roll applicator such as shown in FIG. 10. In this embodiment, the cylinders 8 and 9 are removed and replaced with a Mayer roll unit 75 of a known construction. The gravure cylinder 6 as previously described is mounted in suitable precision bearings to the frames 26 and 27, and is preferably mounted with an other removable bearing cap. The cylinders 8 and 9 are thus conveniently removed by releasing of the respective caps of the impression cylinder coupling 31 and the bearing caps for cylinders 8 and 9.

The present invention particularly through the lead screw unit and power cylinders provide a means to produce precise setting of rotary application.

As used herein, coating refers broadly to the transfer of material to a web by rotating cylinder devices.

Various modes of carrying out the invention are contemplated as being within the scope of the following claims particulary pointing out and distinctly claiming the subject matter which is regarded as the invention.

We claim:

1. A coating apparatus, comprising a support means, an impression cylinder rotatably mounted in said support means, a gravure cylinder rotatably mounted in said support means in spaced relation to said impression cylinder, said impression cylinder and said gravure cylinder being located in fixed rotatable positions relative to each other, an offset cylinder mounted between said impression cylinder and said gravure cylinder and adapted to be operatively coupled to said impression cylinder and said gravure cylinder, a dual pivot assembly connected to rotatably support said offset cylinder for positioning said offset cylinder relative to said impression cylinder and said gravure cylinder and including a first pivot means pivotably mounted to the support means and a second pivot means pivotably mounted to said first pivot means, first positioning means coupled to said first pivot means to position said first pivot means and thereby position the second pivot means and said offset cylinder, and second positioning means coupled to said second pivot means to independently and separately position said second pivot means for setting the spacing of the offset cylinder relative to said impression cylinder.

2. The coating apparatus of claim 1 wherein said impression cylinder and said offset cylinder each have a substantially horizontal axis of rotation, said impression cylinder being located to the outfeed side of said offset cylinder and with the axis of the impression cylinder above the axis of said offset cylinder, said gravure cylinder being located beneath said offset cylinder and horizontally and vertically spaced from said impression cylinder, said first pivot means having a pivot axis coincident with the axis of said impression cylinder, and said second pivot means adjusts the spacing of the offset cylinder with respect to said impression cylinder and said first pivot means adjusts the spacing of the offset cylinder with respect to said gravure cylinder.

3. The coating apparatus of claim 2 wherein said first positioning means includes a movable stop member coupled to position the first pivot means and a hydraulic power means to hold the pivot means against said stop member, and said second positioning means includes a movable stop member coupled to position said second pivot means and a hydraulic power means to hold said second pivot means against the corresponding second stop member.

4. A coating apparatus comprising a rigid fixed supporting framework having two side frames adapted to firmly support a rotary applicating mechanism, comprising a pivot arm unit means pivotably secured to said side frames and a depending pivot arm means depending downwardly from said pivot arm unit means, an offset cylinder means having bearing means secured within the lower end of said depending pivot arm means, first and second power positioning units coupled one each to said pivot arm unit means and to said depending pivot arm means, each of said power positioning units including a preloaded ball bearing lead screw unit and a power cylinder, said power positioning units each including stepping motor means coupled to said lead screw units, said first power positioning unit interconnected to said pivot arm unit means and said second power positioning unit interconnected to said depending pivot arm means for moving the offset cylinder means in increments of low millionth's of an inch, an impression cylinder, a gravure cylinder, means mounting said impression cylinder and said gravure cylinder about the offset cylinder in relatively fixed relation to each other whereby said offset cylinder is positioned relative to said fixed relation.

5. The apparatus of claim 4 having a programmable controller coupled to said motor means of said lead screw units and operable to actuate said stepping motors means to correspondingly and precisely move said offset cylinder and thereby operable to control the thickness of the coating applied to the web passing therebetween.

6. The apparatus of claim 5 having sensor means coupled to the coated web to monitor the thickness of said coating and establish a signal proportional thereto, and means connecting said sensor means to said programmable controller.

7. The coating apparatus of claim 4 wherein said pivot arm unit means includes a pivot arm member rotatably supported on the axis of said impression cylinder, said first power positioning unit connected to the framework and to the outer end of the pivot arm member, a pair of spaced pivot plates coupled to the top edge of said pivot arm member and extending upwardly and over the impression cylinder, a pivot shaft mounted in said pivot plates, said depending pivot arm means being mounted on said shaft between said pivot plates, said second power positioning unit including stop means connected to said pivot arm member and to said depending pivot arm means and power moving means connected to said pivot plates and to said depending pivot arm means.

8. The coating apparatus of claim 7 wherein said power positioning units each include a screw unit defining said stop means and a hydraulic cylinder unit.

9. The coating apparatus of claim 8 including a separate drive means for each of said lead screw units, said drive means including a motor and a harmonic motion reducer connected to said motor and to said lead screw unit.

10. A rotary web coater for depositing a thin film of a liquified coating material onto a flexible moving web of base material, comprising a rigid supporting frame structure including a pair of laterally spaced side frames of a plate-like construction, an impression cylinder having opposite end shafts rotatably mounted at the opposite ends in said side frames and rigidly supporting said cylinder for rotation on a fixed axis in said side frames, a pivot arm member having a precision bearing mounted on said end shafts of said impression cylinder adjacent said frame, a nip adjustment means mounted to said frame and including a pre-loaded ball bearing lead screw rotatably mounted to said frame and having a follower, a slide housing substantially enclosing said lead screw and including a slide means slidably affixed to said side frames to slidably support the housing on the frame, means interconnecting said slide housing to said lead screw for movement in accordance with the rotation of the lead screw, a pivot link pivotally connected to the lower end of said slide housing and pivotally connected to the outer end of said pivot arm member, a power cylinder unit having a cylinder end pivotally affixed to the frame and having a sliding piston rod aligned with said pivot arm member, a clevis connection connecting the pivot arm member to said piston rod, a stepping motor means coupled to said pre-loaded ball bearing lead screw for accurately positioning said pivot arm member against the position of said cylinder unit, a set of pivot arm member extensions extending upwardly from said pivot arm member and including an upper portion extending outwardly over the impression cylinder, said set of arm member extensions including aligned pivot openings, a pivot shaft extended to said openings and having pivot bearings between the shaft and the arm member extensions to rotatably support the shaft in said arms, a depending pivot arm interposed between said extension arms on said shaft and depending downwardly in front of said impression cylinder and having bearing openings; an offset cylinder having end bearings, means securing said bearings within said bearing opening in said depending arms and rotatably supporting said offset cylinder with its axis of rotation parallel to the axis of rotation of said impression cylinder, a preloaded rotary bearing lead screw mechanism, a slide housing slidably secured to the underside of said pivot arm member, a pre-loaded ball bearing lead screw rotatably journaled in said housing and projecting outwardly beneath the pivot arm member, said lead screw mechanism having a follower on said lead screw coupled to said slide housing as a stop, a pivot leg having one end connected to said housing and the opposite end connected to said depending pivot arm, a power cylinder unit secured to said depending pivot arm and to the pivot arm member extensions defining a high force motor means holding the depending pivot arm against said stop, stepping motor means coupled to said lead screw and operable to rotate said lead screw and move said slide housing in increments of a few millionth's of an inch for each step of the stepping motor means, a gravure cylinder mounted within said frame beneath and in alignment with said offset cylinder, a fountain beneath said gravure cylinder and located for immersing the gravure cylinder in a coating material contained within the fountain, said first lead screw operating to pivot said pivot arm member and thereby adjust the nip between said offset cylinder and said gravure cylinder, said second lead screw being operable to move said depending pivot arm to thereby adjust said offset cylinder with respect to said impression cylinder.

11. The coater of claim 10 wherein said depending pivot arm has a plurality of spaced bearing supporting openings for accommodating different size diameter offset cylinders.

12. The coater of claim 10, including thickness sensing means coupled to the web to the discharge side of said impression roll and operable to continuously monitor the thickness of coating for variations in the thickness, a programmable controller having pre-set means and input means connected to said sensor means and developing a signal in accordance with variations in said thickness of said coating said programmable controller having an output means connected to said stepping motor means and operable to adjust the lead screw and thereby the nip setting of said offset cylinder to maintain a constant uniform thickness coating on said web.

13. The coater of claim 11, wherein said bearing openings include first and second pairs of bearing openings spaced from each other in said depending pivot arm, said offset cylinder being removably mounted in said first pair of bearing openings, a second offset cylinder of a substantially smaller diameter than said first named offset cylinder, said second offset cylinder being releasably mounted in said second pair of bearing openings with said first named offset cylinder removed from said first pair of bearing openings, and said gravure cylinder being releasably mounted within said side frames and having means for accommodating a gravure cylinder matched to the offset cylinder.

14. The coater of claim 13, wherein said gravure cylinder is rotatably mounted in said frame structure, and further comprising a vertically movable support connected to said fountain for varying the vertical position of the fountain.

15. The process of applying a coating by passing of a web through a coating applicator having an impression roll rotatably mounted in a fixed bearing structure and a gravure cylinder rotatably mounted in fixed bearing structure and within a fountain having a coating liquid in combination with an offset cylinder rotatably mounted in a support means mounted in a pivotal support having a pivot axis for pivotal movement of said offset cylinder toward and away from the impression cylinder and having a pivotal mounting means connected to said support means for vertical displacement of said support means with respect to said gravure cylinder, said web being adapted to be passed directly in an offset mode of applying the coating to the web and alternatively passed directly between said offset cylinder and said gravure cylinder in a direct mode of applying the coating to the web, said gravure cylinder transferring said coating from said fountain in both said offset mode and said direct mode, comprising the steps of selectively presetting said support means in a first position locating said offset cylinder with respect to the impression cylinder to establish a selected nip pressure with said web passing between said impression cylinder and offset cylinder and operating in said offset mode, or in a second position spacing said offset cylinder with respect to said impression cylinder by a distance to prevent any interaction therebetween with the web passing between the offset cylinder and gravure cylinder and operating in said direct mode, presetting said pivotal mounting means in a first position to adjust the nip between said offset cylinder and said gravure cylinder to transfer the coating to the offset cylinder in said offset mode and in a second position to adjust said nip to permit passage of the web over the offset cylinder with transfer of the coating from the gravure cylinder to the web in said direct mode, after the selectively presetting of the support means and pivotal mounting means, passing said web through said apparatus in said direct mode or in said offset mode to receive said coating material, removing a quantity of coating applied to said web from a selected portion of the coated web, weighing the removed web coating to thereby determine a preselected thickness of the coating, manually readjusting the settings of said support means and said pivotal mounting means for any variation in the determined thickness from said preselected thickness and thereby establish a manually set nip setting of the offset cylinder, and thereafter operating said apparatus in an automatic mode with said manually set nip settings to deposit a uniform thickness of said coating material on said web.

* * * * *

UNITED STATES PATENT AND TRADEMARK OFFICE

CERTIFICATE OF CORRECTION

PATENT NO. : 4,704,296

DATED : November 3, 1987

INVENTOR(S) : Dale D. Leanna

It is certified that error appears in the above-identified patent and that said Letters Patent is hereby corrected as shown below:

Column 6, line 16, "accomodate" should read -- accommodate --.

Column 6, line 60, before "unit" delete "arm"; after "pivot" insert -- arm --.

Column 8, line 17, "positoning" should read -- positioning --.

Column 10, line 53, after "and" insert -- a --.

Column 10, line 57, after "a" insert -- preloaded lead --.

Column 12, line 8, after "coating" insert -- , --(comma).

Signed and Sealed this

Eighth Day of November, 1988

*Attest:*

*Attesting Officer*

DONALD J. QUIGG

*Commissioner of Patents and Trademarks*